United States Patent [19]

Ray et al.

[11] 4,059,441

[45] Nov. 22, 1977

[54] METALLIC GLASSES WITH HIGH CRYSTALLIZATION TEMPERATURES AND HIGH HARDNESS VALUES

[75] Inventors: Ranjan Ray, Morristown; Lee E. Tanner, Summit; Carl F. Cline, Mendham, all of N.J.

[73] Assignee: Allied Chemical Corporation, Morris Township, N.J.

[21] Appl. No.: 740,897

[22] Filed: Nov. 11, 1976

Related U.S. Application Data

[62] Division of Ser. No. 495,458, Aug. 7, 1974, abandoned.

[51] Int. Cl.[2] ..... C22C 27/02

[52] U.S. Cl. ..... 75/174; 75/176

[58] Field of Search ..... 75/174, 170, 176, 134 F

[56] References Cited

U.S. PATENT DOCUMENTS 3,856,513 12/1974 Chen et al. ..... 75/176

OTHER PUBLICATIONS

"Liquid Metals Chemistry and Physics," 1972, pp. 660–666.

Ruhl; "New Microcrystalline Phases in Nb–Ni and Ta–Ni Systems"; Acta Metallurgica, vol. 15, 11/67, pp. 1693–1702.

Metal Abstracts, 5, No. 8 (1972), 12–1047.

*Primary Examiner*—Arthur J. Steiner

*Attorney, Agent, or Firm*—David W. Collins; Arthur J. Plantamura

[57] ABSTRACT

Amorphous metallic alloys having substantial amounts of one or more of the elements of Mo, W, Ta and Nb evidence both high thermal stability, with crystallization temperatures ranging from about 650° C to 975° C, and high hardness, with values ranging from about 800 to 1400 DPH (diamond pyramid hardness).

1 Claim, 2 Drawing Figures

METALLIC GLASSES WITH HIGH CRYSTALLIZATION TEMPERATURES AND HIGH HARDNESS VALUES

This is a division, of application Ser. No. 495,458 filed Aug. 7, 1974, now abandoned.

BACKGROUND OF THE INVENTION

1. Field of the Invention

The invention relates to amorphous metal alloy compositions, and, in particular, to compositions including substantial amounts of one or more of the elements of Mo, W, Ta and Nb, which evidence both high crystallization temperatures and high hardness values.

2. Description of the Prior Art

Investigations have demonstrated that it is possible to obtain solid amorphous metals for certain alloy compositions, and as used herein, the term "amorphous" contemplates "solid amorphous". An amorphous substance generally characterizes a noncrystalline or glass substance; that is, a substance substantially lacking any long range order. In distinguishing an amorphous substance from a crystalline substance, X-ray diffraction measurements are generally suitably employed. Additionally, transmission electron micrography and electron diffraction can be used to distinguish between the amorphous and the crystalline state.

An amorphous metal produces an X-ray diffraction profile in which intensity varies slowly with diffraction angle. Such a profile is qualitatively similar to the diffraction profile of a liquid or ordinary window glass. On the other hand, a crystalline metal produces a diffraction profile in which intensity varies rapidly with diffraction angle.

These amorphous metals exist in a metastable state. Upon heating to a sufficiently high temperature, they crystallize with evolution of a heat of crystallization, and the diffraction profile changes from one having glassy or amorphous characteristics to one having crystalline characteristics.

It is possible to produce a metal which is a two-phase mixture of the amorphous and the crystalline state; the relative proportions can vary from totally crystalline to totally amorphous. An amorphous metal, as employed herein, refers to a metal which is primarily amorphous; that is, at least 50% amorphous, but which may have a small fraction of the material present as included crystallites.

For a suitable composition, proper processing will produce a metal in the amorphous state. One typical procedure is to cause the molten alloy to be spread thinly in contact with a solid metal substrate, such as copper or aluminum, so that the molten metal rapidly loses its heat to the substrate.

When the alloy is spread to a thickness of about 0.002 inch, cooling rates of the order of $10^{6°}$ C/sec may be achieved. See, for example, R. C. Ruhl, Vol. 1, *Mat. Sci. & Eng.*, pp. 313–319 (1967), which discusses the dependence of cooling rates upon the conditions of processing the molten metal. For an alloy of proper composition and for a sufficiently high cooling rate, such a process produces an amorphous metal. Any process which provides a suitably high cooling rate can be used. Illustrative examples of procedures which can be used to make the amorphous metals include rotating double rolls, as described by H. S. Chen and C. E. Miller, Vol. 41, *Rev. Sci. Instrum.*, pp. 1237–1238 (1970), and rotating cylinder techniques, as described by R. Pond, Jr. and R. Maddin, Vol. 245, *Trans. Met. Soc.*, AIME, pp. 2475–2476 (1969).

Amorphous alloys containing substantial amounts of one or more of the elements of Fe, Ni, Co, V and Cr have been described by H. S. Chen and D. E. Polk in a patent application, Ser. No. 318,146, filed Dec. 26, 1972, now U.S. Pat. No. 3,856,513, issued Dec. 24, 1974. Such alloys are quite useful for a variety of applications. Such alloys, however, are characterized by a crystallization temperature of about 425° C to 550° C and a hardness of about 600 to 750 DPH (diamond pyramid hardness).

SUMMARY OF THE INVENTION

In accordance with the invention, amorphous alloys are described having high thermal stability, with crystallization temperatures ranging from about 650° C to 975° C and high hardness, with values ranging from about 800 to 1400 DPH. Two general compositions have these properties and may be classified as follows. The first class of compositions is referred to as metal-metalloid, and has the general formula $R_rM_sX_t$, where R is at least one of the elements of molybdenum, tungsten, tantalum, and niobium, M is at least one of the elements of nickel, chromium, iron, vanadium, aluminum and cobalt, and X is at least one of the elements of phosphorus, boron, carbon and silicon, and where "r" ranges from about 40 to 60 atom percent, "s" ranges from about 20 to 40 atom percent and "t" ranges from about 15 to 25 atom percent. Preferred compositions include compositions where "r" ranges from about 45 to 55 atom percent, "s" ranges from about 25 to 35 atom percent and "t" ranges from about 18 to 22 atom percent. The crystallization temperature of the metal-metalloid compositions ranges from about 800° C to 975° C and the hardness ranges from about 1000 to 1400 DPH.

The second classification is referred to as metal-metal, and includes refractory metal-base glasses of the general formula $R_rNi_sT_t$, where R is at least one of the elements of tantalum, niobium and tungsten and T is at least one of the elements of titanium and zirconium, and where "r" ranges from about 35 to 65 atom percent, "s" ranges from about 25 to 65 atom percent and "t" ranges from 0 to about 15 atom percent. Preferred compositions, where "t" is 0, include the composition region encompassed from $Ta_{35}Ni_sW_{65-s}$ to $Ta_{45}Ni_sW_{55-s}$, where "s" ranges from about 35 to 45 atom percent, and the composition $Ta_rNi_s$, where "r" ranges from about 35 to 50 atom percent and "s" ranges from about 50 to 65 atom percent. The crystallization temperature of the metal-metal compositions ranges from about 650° C to 800° C, and the hardness ranges from about 800 to 1125 DPH.

Such metal glasses, whether metal-metalloid or metal-metal, are particularly useful for heat resistant applications at high temperatures (about 500° to 600° C). Possible applications include use of these materials as electrodes in certain high temperature electrolytic cells, and as reinforcement fibers in composite structural materials.

DETAILED DESCRIPTION OF THE INVENTION

A. Metal-Metalloid Composition

Figure 1:
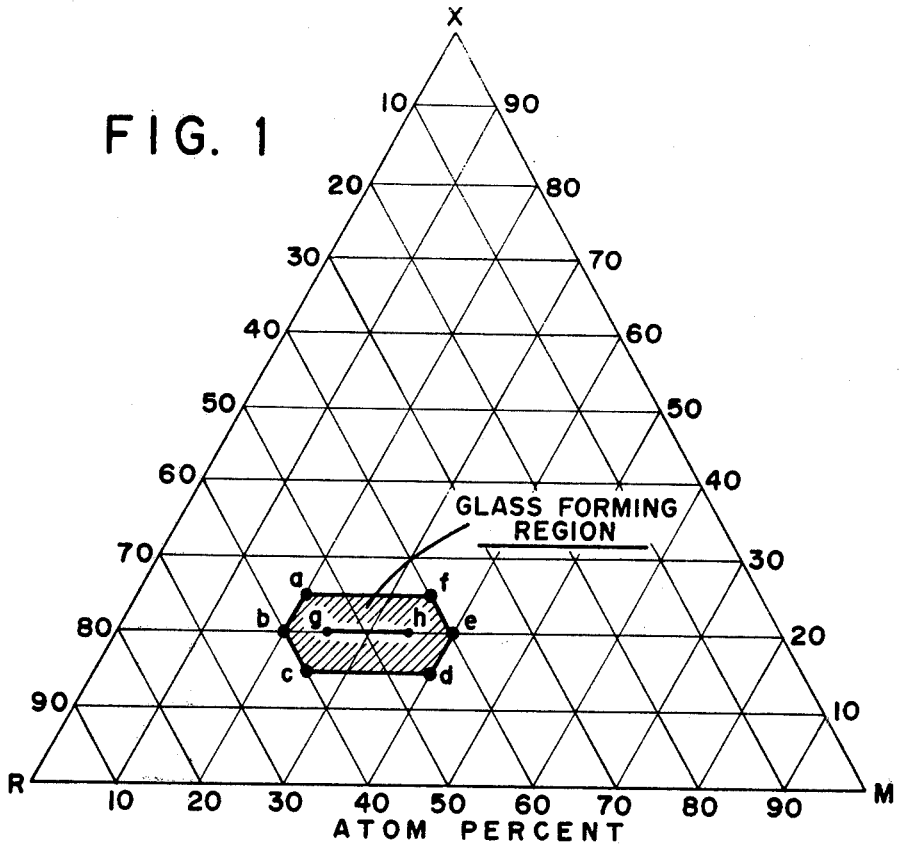
FIG. 1 is a ternary phase diagram in atom percent of the metal-metalloid system R-M-X, where R is one or more of the elements of Mo, W, Ta and Nb, M is one or more of the elements of Ni, Cr, Fe, V, Al and Co and X is one or more of the elements of P, B, C and Si.

Most liquid-quenched glass compositions in various metal-metalloid systems have evidenced crystallization temperatures of about 425° C to 550° C. In accordance with the present invention, compositions represented by the general formula $R_rM_sX_t$ have crystallization temperatures ranging from about 800° C to 975° C. In the formula, R is at least one of the refractory metals of Mo, W, Ta and Nb, M is at least one of the metals of Ni, Cr, Fe, V, Al and Co and X is at least one of the metalloids of P, B, C and Si. The purity of all elements described is that found in normal commercial practice.

For Mo-base compositions, amorphous alloys are formed in systems containing at least about 25 atom percent of Ni, Cr, Fe, V or Al. Typical compositions in atom percent are $Mo_{52}Cr_{10}Fe_{10}Ni_3P_{12}B_8$ and $Mo_{40}Cr_{25}Fe_{15}B_8C_7Si_5$. Such amorphous alloys, or glasses, possess high thermal stability as revealed by DTA (differential thermal analysis) investigation. The temperatures for crystallization peaks, $T_c$, can be accurately determined from DTA by slowly heating the glass sample and noting whether excess heat is evolved at a particular temperature (crystallization temperature) or whether excess heat is absorbed over a particular temperature range (glass transition temperature). In general, the less well-defined glass transition temperature $T_g$ is considered to be within about 50° below the lowest, or first, crystallization peak, $T_{cl}$, and, as is conventional, encompasses the temperature region over which the viscosity ranges from about $10^{13}$ to $10^{14}$ poise.

The various Mo-base glasses with about 25 to 32 atom percent Ni, Cr, Fe, Al (either single or combined), plus about 12 atom percent P and about 8 atom percent B, crystallize in the range of about 800° C to 900° C. Substitution of P by C or Si by 6 to 8 atom percent increases $T_c$ by about 40° C to 50° C. Further thermal stability is achieved by partial substitution of W for Mo. Alloys containing about 8 to 20 atom percent W have crystallization temperatures in the range of about 900° C to 950° C.

High $T_g$ glass-forming compositions exist also in W-base alloys. Typically, these alloys contain about 15 to 25 atom percent Mo, about 25 atoms percent Ni, Fe, and Cr, and about 20 atom percent P, B, C and Si. These alloys glasses are remarkably stable and crystallize at temperatures in excess of 950° C. For example, one glass composition, $W_{40}Mo_{15}Cr_{15}Fe_5Ni_5P_6B_6C_5Si_3$, evidences two crystallization peaks, 960° C and 980° C, in a DTA trace. However, as W content is increased to beyond 40 atom percent, it becomes increasingly difficult to form a glass.

The glasses are formed by cooling a melt at a rate of about $10^{5°}$ to $10^{6°}$ C sec. A variety of techniques are available, as is well-known in the art, for fabricating splat-quenched foils and rapid-quenched continuous ribbon, wire, etc.

Glasses evidencing high $T_g$ properties as described above also evidence high ductility and high corrosion resistance compared to crystalline or partially crystalline samples. In addition, these amorphous alloys have rather high hardness values. Typically, the hardness for Mo- and W-base glasses ranges from about 1000 to 1400 DPH (diamond pyramid hardness). This is to be compared with amorphous alloys of metal-metalloid compositions comprising substantial amounts of Fe or Fe-Ni, but lacking any substantial amount of refractory metal. For these latter alloys, the hardness usually is about 600 to 750 DPH.

Shown in FIG. 1 is a ternary phase diagram of the system R-M-X, where R is Mo, W, Ta and/or Nb, M is Ni, Cr, Fe, V, Al and/or Co, and X is P, B, C and/or Si. The polygonal region designated a-b-c-d-e-f-a encloses the glass-forming region that also includes composition having high $T_g$ and high hardness. Outside this composition region, either a substantial degree of amorphousness is not attained or the beneficial properties are unacceptably reduced.

The compositional boundaries of the polygonal region are described as follows: "r" ranges from about 40 to 60 atom percent, "s" ranges from about 20 to 40 atom percent, and "t" ranges from about 15 to 25 atom percent. The highest values of $T_g$ and hardness are formed in compositions represented by the "line" g-h, that is, in which "r" ranges from about 45 to 55 atom percent, "s" ranges from about 25 to 35 atom percent, and "t" ranges from about 18 to 22 atom percent (more specifically, "t" is about 20 atom percent). Accordingly, this latter composition range is preferred. Maximum benefit is derived for compositions where R is Mo and/or W and M is Ni, Fe and/or Cr.

B. Metal-Metal Compositions

Also in accordance with the present invention, alloys providing consistent glass-forming behavior plus high thermal stability include the binary systems Ta-Ni, Nb-Ni and ternary modifications with W, Ti and/or Zr. Here, the compositions of interest may be described by the general formula $R_rNi_sT_t$, where R is Ta, Nb and/or W and T is Ti and/or Zr. Such compositions have crystallization temperatures ranging from about 650° C to 800° C.

Ta-Ni binary glasses crystallize in the range 760° C to 780° C, which is about 100° C higher than those for Nb-Ni glasses. The partial substitution of W for Ta raises $T_c$ only slightly (about 15° C to 20° C) and does not change appreciably with increasing W content. On the other hand, partial addition of Ti or Zr tends to lower $T_c$.

For the binary compositions of $Ta_rNi_s$ and $Nb_rNi_s$, glasses are formed where "r" ranges from about 35 to 65 atom percent and "s" is the balance, that is, 35 to 65 atom percent (t=0). Optimum properties are obtained in the system $Ta_rNi_s$, where "r" ranges from about 35 to 50 atom percent and "s" ranges from about 50 to 65 atom percent.

Figure 2:
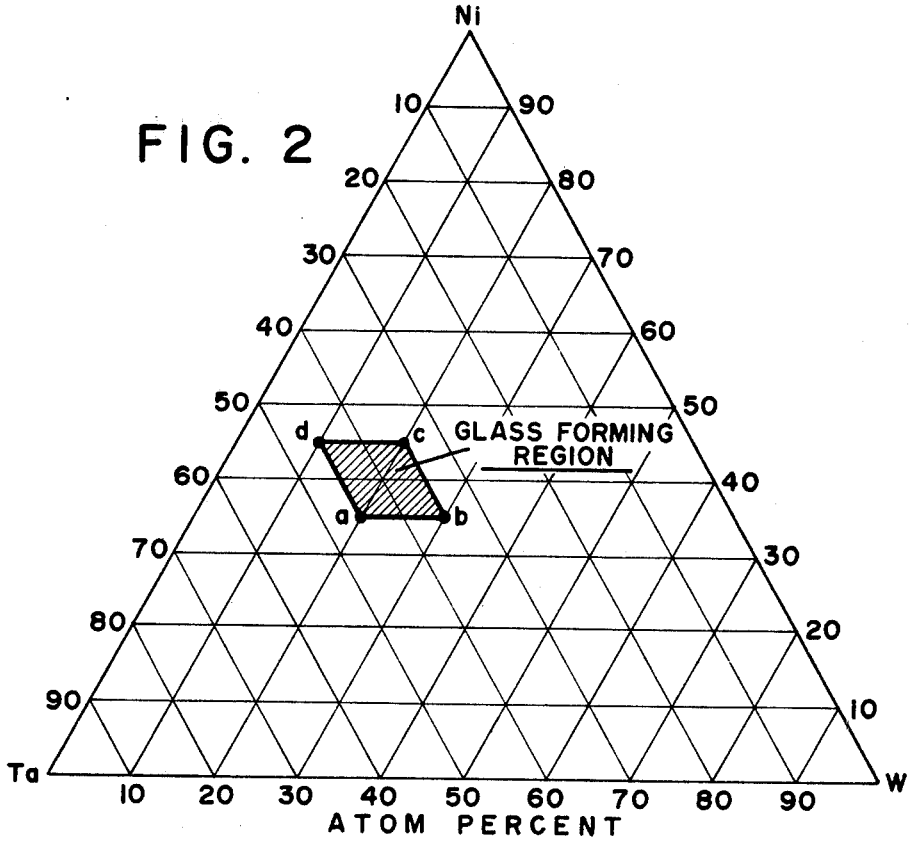
FIG. 2 is a ternary phase diagram in atom percent of the metal-metal system Ta-W-Ni.

For the ternary composition region from $Ta_{35}Ni_sW_{65-s}$ to $Ta_{45}Ni_sW_{55-s}$, a glass-forming region that is consistent with high $T_g$ and high hardness is shown in FIG. 2, which is a ternary phase diagram of the system Ta-W-Ni. The polygonal region designated a-b-c-d-a encompasses the optimum glass-forming region. Outside this composition region, either a substantial degree of amorphousness is not attained or the beneficial properties are unacceptably reduced. In FIG. 2, "s" ranges from about 35 to 45 atom percent.

Since the addition of Ti or Zr tends to lower $T_c$, then such addition should not exceed about 15 atom percent, and preferably 10 percent, to retain the advantages of high $T_g$ and high hardness.

In general, the hardness of the foregoing systems ranges from about 800 to 1125 DPH.

EXAMPLES

A. Metal-Metalloid Compositions

A pneumatic arc-splat unit for melting and liquid quenching high temperature reactive alloys was used. The unit, which was a conventional arc-melting button furnace modified to provide "hammer and anvil" splat quenching of alloys, under inert atmosphere, included a stainless steel chamber connected with a 4 inch diffusion pumping system. The quenching was accomplished by providing a flat-surfaced water-cooled copper hearth on the floor of the chamber and a pneumatically driven copper-block hammer poised above the molten alloy. As is conventional, arc-melting was accomplished by negatively biasing a copper shaft provided with a tungsten tip inserted through the top of the chamber and by positively biasing the bottom of the chamber. Alloys containing P were prepared by sintering powder ingredients followed by arc-melting to homogenization. All other alloys were prepared directly by repeated arc-melting of constituent elements. A single alloy button (about 200 mg) was remelted and then "impact-quenched" into a foil about 0.004 inch thick by the hammer situated just above the molten pool. The cooling rate attained by this technique was about $10^{5°}$ to $10^{6°}$ C/sec. The foils were checked for amorphousness by X-ray diffraction and DTA.

The impact-quenched foil directly beneath the hammer may have suffered plastic deformation after solidification. However, portions of the foil formed from the melt spread away from the hammer were undeformed and hence suitable for hardness and other related tests. Hardness was measured by the diamond pyramid technique, using a Vickers-type indenter consisting of a diamond in the form of a square-based pyramid with an included angle to 136° between opposite faces.

The crystallization temperatures and hardness values are shown in Table I for a variety of metal-metalloid compositions.

TABLE I

CRYSTALLIZATION TEMPERATURES ($T_{cl}$) AND HARDNESS (DPH) MEASUREMENTS FOR METAL-METALLOID COMPOSITIONS

| Example | Composition atom % | $T_{cl}$, ° C | Hardness DPH |
|---|---|---|---|
| 1 | $Mo_{48}Cr_{32}P_{12}B_8$ | 878 | — |
| 2 | $Mo_{48}Fe_{32}P_{12}B_8$ | 828 | — |
| 3 | $Mo_{48}Ni_{32}P_{12}B_8$ | 805 | — |
| 4 | $Mo_{50}Fe_{10}Al_{20}P_{10}B_7Si_3$ | 837 | 1026 |
| 5 | $Mo_{52}Cr_{14}Fe_{14}P_{12}B_8$ | 863 | 1260 |
| 6 | $Mo_{52}Cr_{10}Fe_{10}Ni_8P_{12}B_8$ | 831 | 1234 |
| 7 | $Mo_{40}Cr_{25}Fe_{15}B_8C_7Si_5$ | 913 | — |
| 8 | $Mo_{40}W_{10}Cr_{30}P_{15}B_5$ | 881 | — |
| 9 | $Mo_{35}W_{20}Cr_{18}Fe_7P_6B_6C_5Si_3$ | 950 | — |
| 10 | $Mo_{40}W_{15}Cr_{18}Fe_7P_6B_6C_5Si_3$ | 894 | — |
| 11 | $Mo_{35}W_{15}Cr_{25}Fe_5P_6B_6C_5Si_3$ | 920 | — |
| 12 | $Mo_{40}W_8Cr_{24}Fe_8P_6B_6C_5Si_3$ | 902 | 1392 |
| 13 | $Mo_{30}Nb_{20}Cr_{30}P_8B_7Si_5$ | 903 | 1187 |
| 14 | $W_{30}Mo_{25}Cr_{18}Fe_7P_6B_6C_5Si_3$ | 950 | 1350 |
| 15 | $W_{35}Mo_{20}Cr_{15}Fe_5Ni_5P_6B_6C_5Si_3$ | 946 | 1378 |
| 16 | $W_{40}Mo_{15}Cr_{15}Fe_5Ni_5P_6B_6C_5Si_3$ | 960 | 1396 |

B. Metal-Metal Compositions

Various metal-metal compositions were prepared and measured as described above. The results of the crystallization temperature and hardness are shown in Table II.

TABLE II

CRYSTALLIZATION TEMPERATURES ($T_{cl}$) AND HARDNESS (DPH) MEASUREMENTS FOR METAL-METAL SYSTEMS

| Example | Composition, atom % | $T_{cl}$, ° C | Hardness DPH |
|---|---|---|---|
| 17 | $Ta_{55}Ni_{45}$ | 780 | 1111 |
| 18 | $Ta_{50}Ni_{50}$ | 767 | 941, 1115 |
| 19 | $Ta_{45}Ni_{45}W_{10}$ | 797 | 818, 969 |
| 20 | $Ta_{45}Ni_{40}W_{15}$ | 796 | — |
| 21 | $Ta_{45}Ni_{35}W_{20}$ | 800 | — |
| 22 | $Ta_{35}Ni_{45}W_{20}$ | 791 | — |
| 23 | $Ta_{35}Ni_{35}W_{30}$ | 800 | — |
| 24 | $Ta_{55}Ni_{35}Zr_{10}$ | 683 | — |
| 25 | $Ta_{55}Ni_{35}Ti_{10}$ | 709 | — |
| 26 | $Ta_{50}Ni_{40}Ti_{10}$ | 717 | — |
| 27 | $Nb_{65}Ni_{35}$ | 662 | 960 |
| 28 | $Nb_{60}Ni_{40}$ | 680 | 923 |
| 29 | $Nb_{50}Ni_{50}$ | 653 | 863 |
| 30 | $Nb_{60}Ni_{28}Ti_{12}$ | 662 | — |

What is claimed is:

1. A metal alloy at least 50% amorphous having a high crystallization temperature and a high hardness, characterized in that the alloy has the composition ranging from $Ta_{35}Ni_sW_{65-s}$ to $Ta_{45}Ni_sW_{55-s}$, where "s" ranges from about 35 to 45 atom percent.

* * * * *